US011959337B2

(12) United States Patent
Purcell

(10) Patent No.: US 11,959,337 B2
(45) Date of Patent: Apr. 16, 2024

(54) DRILLING UNIT

(71) Applicant: Mincon Nordic Oy, Ylöjärvi (FI)

(72) Inventor: Joseph Purcell, Ylöjärvi (FI)

(73) Assignee: MINCON NORDIC OY, Ylöjärvi (FI)

( * ) Notice: Subject to any disclaimer, the term of this patent is extended or adjusted under 35 U.S.C. 154(b) by 64 days.

(21) Appl. No.: 17/638,151

(22) PCT Filed: Aug. 25, 2020

(86) PCT No.: PCT/FI2020/050550
§ 371 (c)(1),
(2) Date: Feb. 24, 2022

(87) PCT Pub. No.: WO2021/038131
PCT Pub. Date: Mar. 4, 2021

(65) Prior Publication Data

US 2022/0298868 A1 Sep. 22, 2022

(30) Foreign Application Priority Data

Aug. 26, 2019 (FI) ..... 20195702

(51) Int. Cl.
*E21B 10/62* (2006.01)
*E21B 10/64* (2006.01)

(52) U.S. Cl.
CPC ..... *E21B 10/64* (2013.01); *E21B 10/62* (2013.01)

(58) Field of Classification Search
CPC ..... E21B 10/62; E21B 10/64
See application file for complete search history.

(56) References Cited

U.S. PATENT DOCUMENTS 4,208,154 A * 6/1980 Gundy ..... B28D 1/041 125/20
5,957,226 A 9/1999 Holte
2006/0027399 A1 2/2006 Holte et al.
2010/0071563 A1 3/2010 Ryser et al.
(Continued)

FOREIGN PATENT DOCUMENTS

CN 109915026 6/2019
EP 1 837 481 9/2007
EP 2 407 630 1/2012
(Continued)

OTHER PUBLICATIONS

May 4, 2023 Search Report issued in European Patent Application No. 20857606.6, pp. 1-8.
(Continued)

*Primary Examiner* — D. Andrews
*Assistant Examiner* — Ronald R Runyan
(74) *Attorney, Agent, or Firm* — Nixon & Vanderhye PC

(57) ABSTRACT

A drilling unit for drilling a hole, wherein the drilling unit comprising a drilling head (1). Said drilling head (1) further comprising pulling means (2) for pulling a casing (7) into the hole, a pilot bit (3) for drilling a center hole, connecting means and a ring bit assembly (4) for reaming the center hole for the casing (7). Said ring bit assembly (4) being connected to said pilot bit (3) by the connecting means and to said casing (7) by the pulling means (2). Said ring bit assembly (4) comprising a carrier (5) comprising carrier coupling means (23) and a plurality of ring bit segments (6) movably attached to said carrier coupling means (23).

18 Claims, 3 Drawing Sheets

(56) References Cited

U.S. PATENT DOCUMENTS

| | | | |
|---|---|---|---|
| 2015/0300094 | A1 | 10/2015 | Hisada et al. |
| 2016/0281435 | A1 | 9/2016 | Gylling |

FOREIGN PATENT DOCUMENTS

| | | | | |
|---|---|---|---|---|
| FI | 124451 | | 9/2014 | |
| FI | 11444 | | 11/2016 | |
| JP | 7 229382 | | 8/1995 | |
| KR | 10 2013 0033566 | | 4/2013 | |
| KR | 1020140096336 | | 8/2014 | |
| KR | 10-2016-0099530 | | 8/2016 | |
| WO | 95/34740 | | 12/1995 | |
| WO | 2010/071563 | | 6/2010 | |
| WO | 2013/084994 | | 6/2013 | |
| WO | WO-2017046449 | A1 * | 3/2017 | ..... E21B 10/32 |

OTHER PUBLICATIONS

International Search Report for PCT/FI2020/050550 dated Nov. 23, 2020, 5 pages.
Written Opinion of the ISA for PCT/FI2020/050550 dated Nov. 23, 2020, 7 pages.
FI Search Report for 20195702 dated Mar. 23, 2020, 2 pages.
FI Office Action for 2019/5702 dated Mar. 24, 2021, 6 pages.
Aug. 5, 2023 Office Action issued in Korean Patent Application No. 10-2022-7007116, pp. 1-4.
Feb. 6, 2024 Office Action issued in Korean Patent Application No. 10-2022-7007116; pp. 1-3.

* cited by examiner

DRILLING UNIT

This application is the U.S. national phase of International Application No. PCT/FI2020/050550 filed Aug. 25, 2020 which designated the U.S. and claims priority to FI Patent Application No. 20195702 filed Aug. 26, 2019, the entire contents of each of which are hereby incorporated by reference.

FIELD OF THE INVENTION

The present invention relates to drilling a hole in the ground. More particularly, the present invention is directed to a drilling unit and an arrangement for drilling a hole, and a method for producing ring bit segments.

BACKGROUND OF THE INVENTION

A drilling device is used when drilling a hole in the ground. Conventionally the drilling device comprises a drilling unit that is fed into the hole to be drilled. The drilling device has a casing inside of which there is the drilling unit. The drilling unit has a drilling head, which comprises pulling means for pulling a casing into the hole and a pilot bit for drilling a center hole. The drilling device comprises also a ring bit connected to the casing for reaming the center hole for the casing. After drilling and installing a casing into the hole, the pilot bit is pulled out of the hole through the casing. Because the ring bit is connected to the casing, it is left into the hole with the casing. This means that the ring bit is not reusable and a new ring bit is needed every time a hole is drilled. This increases cost of the drilling.

There is also used a drilling device comprising a casing inside of which there is a drilling unit that is fed into the hole to be drilled. The drilling unit comprises a drilling head having a pilot bit with a plurality of wings and pulling means for pulling a casing into a hole during the drilling. When the wings are in an extended state, they are drilling a larger hole to the casing and when they are in a retracted position, they are drilling a smaller hole. The pilot bit wings can be either feed activated or rotation activated. When drilling a hole in the ground, the feed activated pilot bit is pushed against the bottom of the hole and the wings are pushed out with an internal mechanism and locked to this position. After drilling and installing a casing into the hole, the wings are retracted by pulling out the pilot pit. The rotation activated pilot bit is activated by pushing the pilot bit against the bottom of the hole and rotating it to the one direction to turn or slide wings to an extended position. With reverse rotation, the wings are retracted to an original position. After drilling, the pilot bit with the retracted wings are pulled up and out of the hole through the casing.

When using a drilling device where wings are attached to a pilot bit body, several drawbacks has been discovered, mainly relating to the construction of the arrangement. First, designing wings that can be extracted and retracted in challenging conditions in the ground is very complicated. Furthermore, complicated locking means are used to lock the wings to the pilot bit and in many cases; replacing or repairing the wings is difficult or even impossible. In addition, locking the wings to the extracted or retracted position tends to fail causing unintentional closing and opening of the wings and unnecessary breaks to the work.

BRIEF DESCRIPTION OF THE INVENTION

An object of the present invention is, thus, to provide a new apparatus and an arrangement for drilling a hole, and a method for producing ring bit segments to solve the above problems. The objects of the invention are achieved by a method and an arrangement, which are characterized by what is stated in the independent claims. Some of the preferred embodiments of the invention are disclosed in the dependent claims.

The invention is based on the idea of providing a new kind of drilling unit for drilling a hole wherein ring bit segments are removable attached to a carrier.

An advantage of the arrangement and method of the invention is that ring bit segments are separated from a pilot bit body and attached to a carrier, thus making the design very simple. With the apparatus and the method of the invention, it is easy to replace the ring bit segments and the ring bit assembly. In addition, locking of the ring bit segments to an extracted or retracted position is simple. After drilling and installing a casing into the hole it is easy to take the ring bit assembly out of the hole with the pilot bit. Thus, the ring bit assembly is reusable decreasing drilling costs. Other advantages of the solution are explained in connection with the description.

BRIEF DESCRIPTION OF THE DRAWINGS

In the following the invention will be described in greater detail by means of preferred embodiments with reference to the attached drawings, in which.

DETAILED DESCRIPTION OF THE INVENTION

The following embodiments are exemplary. Although the specification may refer to "an", "one", or "some" embodiment(s) in several locations of the text, this does not necessarily mean that each reference is made to the same embodiment(s), or that a particular feature only applies to a single embodiment. Single features of different embodiments may also be combined to provide other embodiments.

Figure 1:
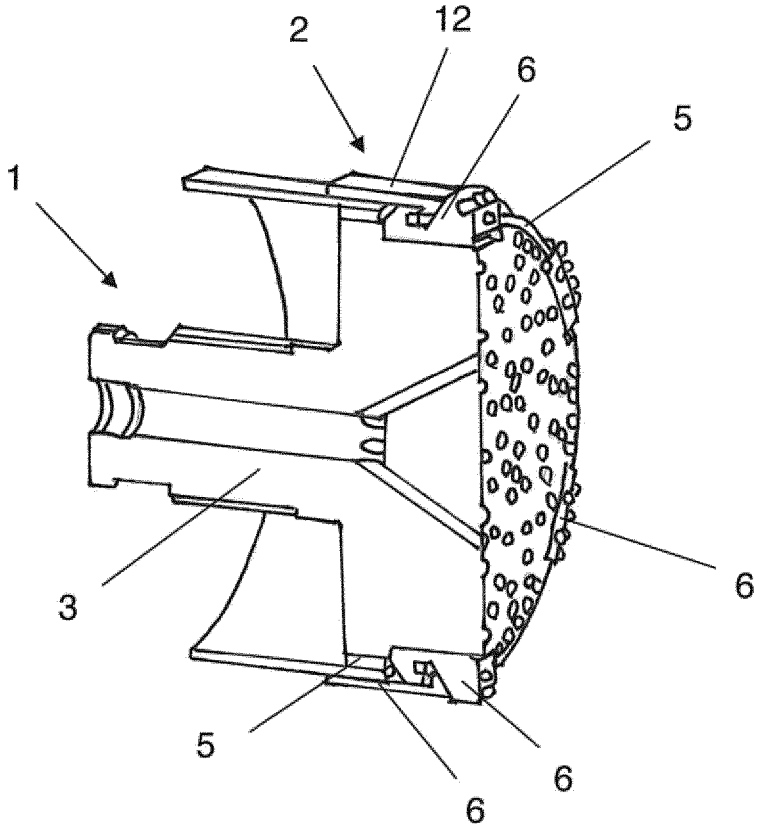
FIG. 1 illustrates a drilling head according to an embodiment.

A drilling device is used when drilling a hole in the ground and pulling a casing into the hole at the same time. It comprises a drilling unit that is fed into the hole to be drilled. The drilling device comprises further a casing inside of which there may be, at least during a drilling situation, said drilling unit. The drilling unit comprising a drilling head 1 according to an embodiment, which is illustrated in FIG. 1. The drilling head 1 may further comprise pulling means 2 for pulling a casing 7 into the hole, a pilot bit 3 for drilling a center hole, connecting means, and a ring bit assembly 4 for reaming the center hole for the casing 7. The ring bit assembly 4 transmits pulling forces from the pilot bit 3 to the casing 7. The ring bit assembly 4 may be connected to said pilot bit 3 by the connecting means and to said casing 7 by the pulling means 2.

Figure 3A:
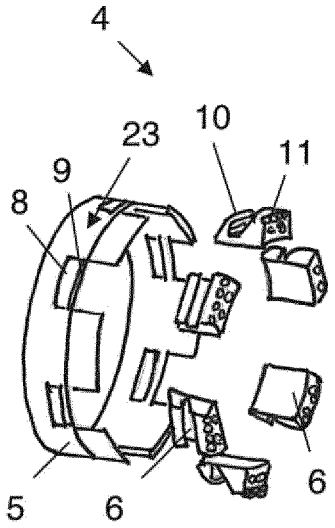
FIG. 3*a* is an exploded view of a ring bit assembly according to an embodiment.
Figure 3B:
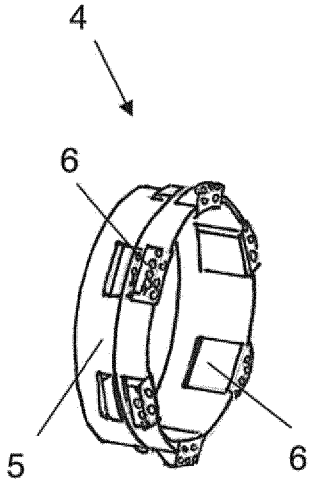
FIG. 3*b* illustrates the ring bit assembly according to FIG. 1 when the ring bit segments are in an extended position.
Figure 3C:
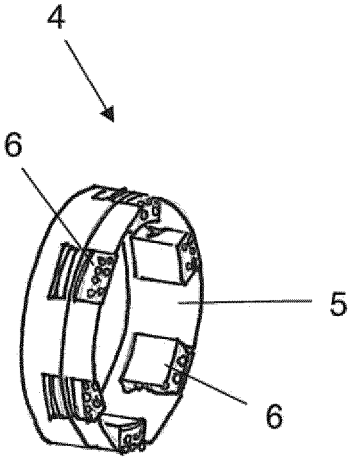
FIG. 3*c* illustrates the ring bit assembly according to FIG. 1 when the ring bit segments are in a retracted position.

FIGS. 3*a*-3*c* are exemplary embodiments of a ring bit assembly 4 that may be used in FIG. 1 arrangement. FIG. 3*a* is an exploded view of the ring bit assembly 4. The ring bit assembly 4 may comprise a carrier 5 comprising carrier coupling means 23 and a plurality of ring bit segments 6 movably attached to said carrier coupling means 23. The carrier coupling means 23 may comprise a plurality of carrier holes 8 and carrier ribs 9. Preferable there may be six holes 8 and ribs 9 but also other amounts are possible. The ring bit segment 6 may comprise a segment impact shoulder 10 and a segment reamer shoulder 11 on an outer surface of the ring bit segment 6. The outer surface of the ring bit segment 6 is a surface, which is facing an inner surface of the carrier 5 before attached to the carrier 5 and goes partly through the hole 8 when attached to the carrier 5. The segment impact shoulder 10 delivers an impact force or a pulling force from the pilot bit 3 to the casing 7. It serves also as a locking mean between the carrier 5 and the ring bit segment 6. The segment impact shoulder 10 has a hook-type geometry to ensure that the ring bit segment 6 will stay in place when handling the casing 7, casing shoe 12, carrier 5, and ring bit segments 6. Once the pilot bit 3 is inside the ring bit assembly 4, no other locking means are required.

FIG. 3*b* illustrates a situation where the segment impact shoulders 10 of the ring bit segments 6 are attached into the carrier holes 8, and wherein the segment reamer shoulders 11 and the segment impact shoulders 10 are arranged to attach the ring bit segments 6 to the carrier ribs 9 from the inside of the carrier 5, when said ring bit segments 6 are in the extended position. The ring bit segments 6 may be radially extendable and retractable, therefore they may move inside and outside of the carrier holes 8. The ring bit segments 6 may be arranged in an extended position when reaming the center hole for the casing 7. Thus, the ring bit segments 6 may be arranged in the extended position located further out than an outer diameter of the casing 7.

FIG. 3*c* shows how the ring bit segments 6 may be arranged in a retracted position when removing the ring bit assembly 4 from a hole. When the ring bit segments 6 are arranged in a retracted position, they are located further in than an inner diameter of the casing 7. When removing the ring bit assembly 4 from the hole, the segment reamer shoulders 11 may be moved inside the casing 7 onto the carrier ribs 9. This way the outer surfaces of the segment reamer shoulders 11 are at the same level as the outer diameter of the carrier 5 and the segment impact shoulders 10 may not be inside the carrier holes 8 at all. This means, that the segment reamer shoulders 11 may rest on the carrier ribs 9 allowing the carrier 5 together with segments 6 to move freely inside the casing 7 and out of the hole.

Figure 2:
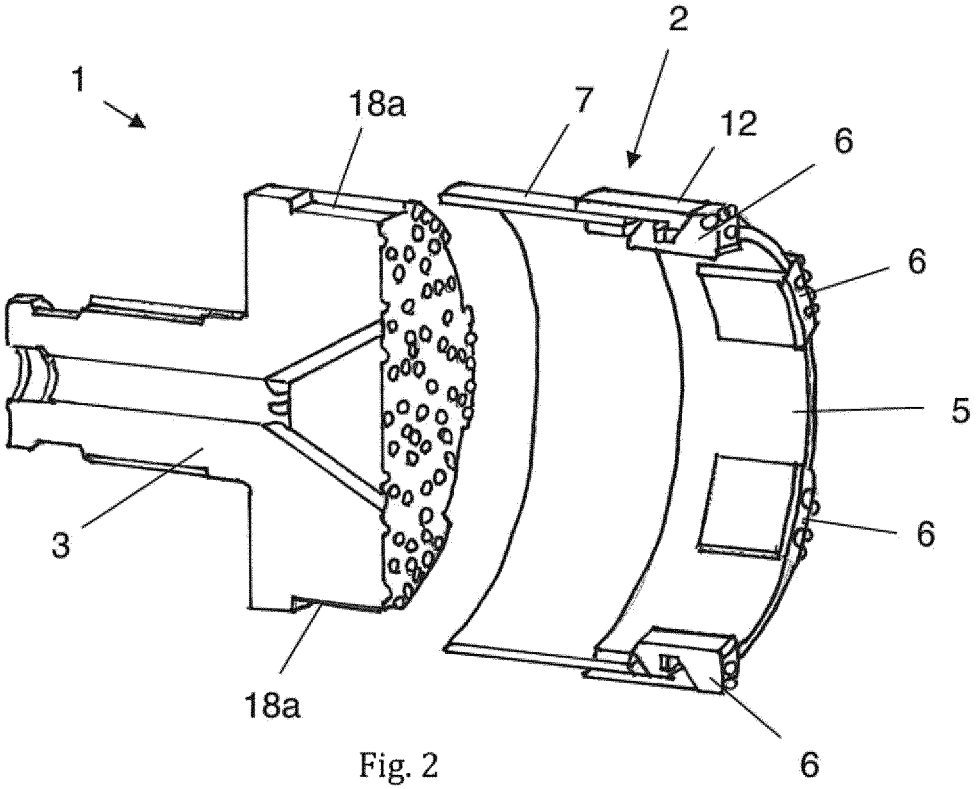
FIG. 2 is an exploded view of the drilling head according to FIG. 1.

FIG. 2 is an exploded view of a drilling head according to FIG. 1. The casing 7 and the ring bit assembly 4 may be connected together by the pulling means 2, and the pilot bit 3 may be connected to the ring bit assembly 4 by the ring bit segments 6. The pulling means 2 may comprise a casing shoe 12 at the head of the casing 7 for coupling the casing 7 and the ring bit segments 6 movably together and allowing the ring bit assembly 4 to rotate freely around the longitudinal axis of the casing 7. The casing shoe 12 is fixed to the casing 7 for example by welding. FIG. 2 shows that the carrier 5 is not connected or coupled to the pilot bit 3 or the casing shoe 12. Thus, the carrier 5 is uncoupled to the pilot bit. On the other hand, the ring bit segments 2 are connected to the carrier 5, the pilot bit 3 and the casing shoe 12. The carrier 5 may rotate in relation to the pilot bit 3 and/or move in the drilling direction when the ring bit segments 6 have not been locked to the pilot bit 3. However, when the ring bit segments 6 are locked to the pilot bit 3 and the carrier, the carrier 5 may rotate with the pilot bit 3. The carrier 5 may not transmit any impact forces, because the impact forces are transmitted directly from the pilot bit 3 to the segments 6. Neither does the carrier 5 take part of the drilling, because it is just a sleeve or a ring that keeps the segments 6 in place when drilling. One advantage of the carrier 5 is that it allows easy and fast switching of the segments 6.

Figure 4:
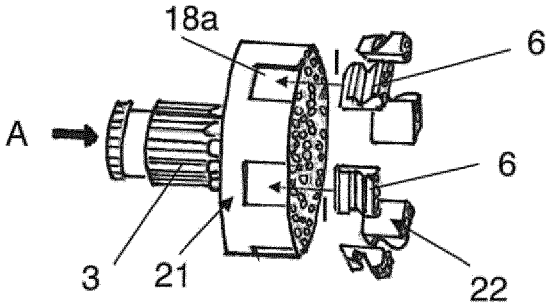
FIG. 4 shows how ring bit segments are sliding into grooves of a pilot bit according to an embodiment.

FIG. 4 shows how ring bit segments 6 of a ring bit assembly 4 may be connected to a pilot bit 3 along longitudinal grooves 18*a* of a pilot bit 3. To clarify the FIG. 4, the carrier 5 of the ring bit assembly 4 is not shown. The ring bit assembly 4 may be connected to said pilot bit 3 by connecting means. The connecting means may comprise first locking means 21 located on a circumferential outer surface of the pilot bit 3 and second locking means 22 located on a surface of the ring bit segment 6. The second locking means 22 may comprise an inner surface of the ring bit segment 6. The first locking 21 means may be arranged to receive said second locking means 22 for locking the ring bit assembly 4 and the pilot bit 3 together. The first locking means 21 may comprise longitudinal grooves 18*a* located on the outer surface of the pilot pit 3 and they go to the direction of the longitudinal axis of the pilot pit 3. The longitudinal grooves 18*a* may be arranged to receive the ring bit segments 6 for locking the ring bit assembly 4 and the pilot bit 3 together when reaming the center hole for the casing 7. An arrow A shows how the pilot pit is pushed into the casing 7 where the ring bit assembly 4 is connected to the casing 7 with the outer surfaces of the ring bit segments 6. Furthermore, arrows I show sliding of the inner surfaces of the ring bit segments 6 along the longitudinal grooves 18*a* of the pilot bit 3. The pilot bit 3 may be used to provide the rotation and the impact of the pilot bit 3 to the ring bit segments 6. With the above-mentioned arrangement, the ring bit segments 6 are forced to rotate with the pilot bit 3 and they move with the pilot bit 3 along the direction of drilling. Thus, the ring bit segments 6 and the longitudinal grooves 18*a* may lock the ring bit assembly 4 and the pilot bit 3 together in a manner that prevents failing of the locking. The ring bit segments 6 connect the ring bit assembly 4 and the pilot bit 3 rotationally together with the inner surfaces of the ring bit segments 6, so that unintentional closing and opening of the ring bit segments 6 is not possible. This way the pilot bit 3 may prevent the ring bit segments 6 to collapse unintentionally to the retracted position when reaming the hole.

Figure 5A:
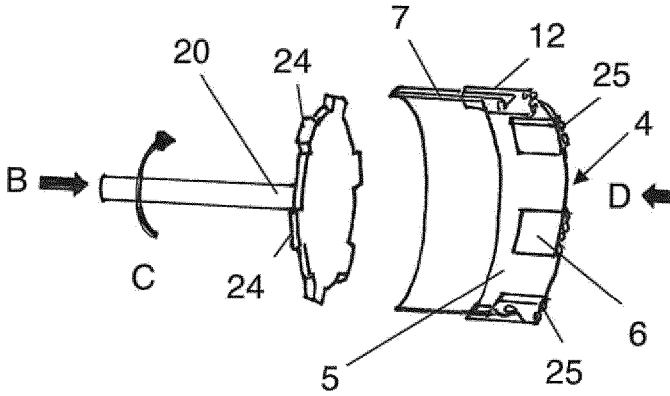
FIG. 5*a* illustrates a lifting tool and a ring bit assembly connected to a casing according to an embodiment.
Figure 5B:
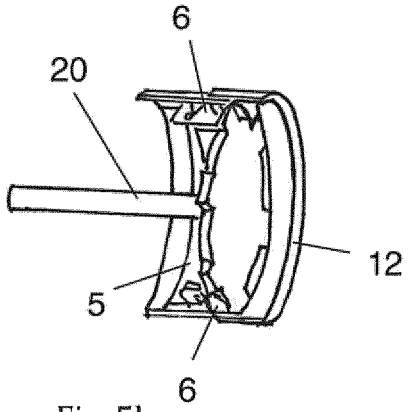
FIG. 5*b* shows retrieving of the ring bit assembly with the lifting tool.

FIGS. 5*a* and 5*b* shows a lifting tool 20 to be used for removing a ring bit assembly 4 from a hole and from a casing 7. FIG. 5*a* illustrates a lifting tool 20 and a ring bit assembly 4 connected to a casing 7 according to an embodiment. The lifting tool may comprise a plurality of protrusions 24. Amount of the protrusions 24 is the same as ring bit segments 6. After drilling the hole, the pilot bit 3 may be pulled up and out of the hole through the casing 7, when the ring bit assembly 4 may stay in the hole with the casing shoe 7. The lifting tool 20 may slid inside of the casing 7 according to the arrow B. When the lifting tool 20 is located to the bottom of the hole, it may be turned according to an arrow C so that the protrusions 24 are located on the drilling surfaces 25 of the ring bit segments 6. Thereafter, the lifting tool 20 may be moved according to an arrow D in FIG. 5*b* to move the ring bit segments 6 inwards, which releases the connection between the ring bit assembly 4 and the casing shoe 7. FIG. 3*c* shows the situation where the ring bit segments 6 are in a retracted position. Subsequently, the ring bit assembly 4 may be lifted out of the hole without the casing 7 with the lifting tool 20 according to the arrow D.

Figure 6:
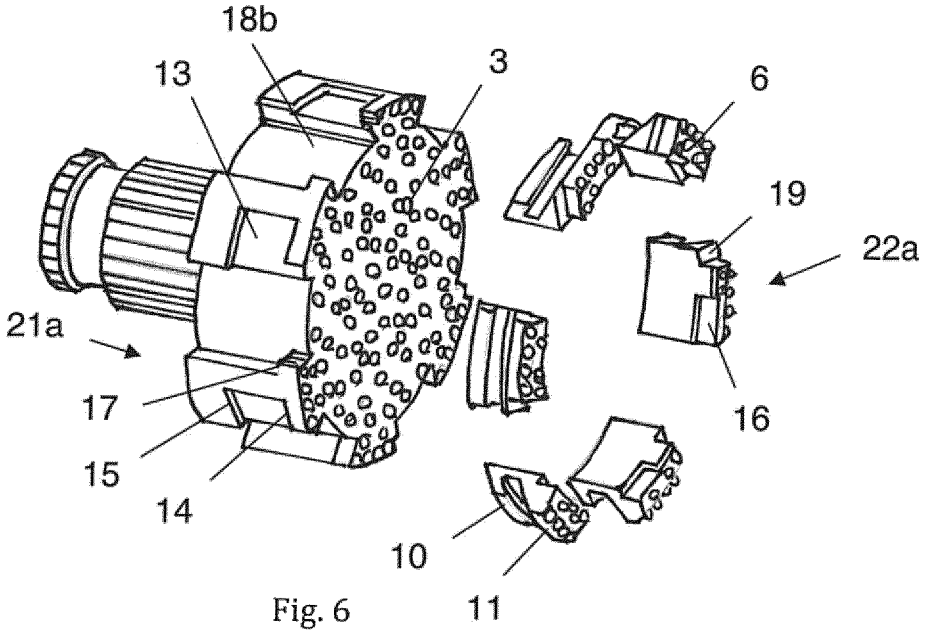
FIG. 6 is an exploded view of a pilot bit and ring bit segments according to another embodiment.

FIG. 6 is an exploded view of another embodiment of a pilot bit 3 and ring bit segments 6. It shows how a pilot bit 3 may be connected to ring bit segments 6 of a ring bit assembly 4 along circumferential grooves 13 of the pilot bit 3. To clarify FIG. 6, the carrier 5 of the ring bit assembly 4 has been removed. The ring bit assembly 4 according to FIGS. 3*a*-3*c* may be used also in this embodiment. However, locking means 22*a* of the ring bit segments 6 are different and function differently. The ring bit assembly 4 may be connected to the pilot bit 3 by the connecting means. The connecting means may comprise first locking means 21*a* located on a circumferential outer surface of the pilot bit 3 and second locking means 22*a* located on a surface of the ring bit segment 6. The second locking means 22*a* may comprise an inner and side surface of the ring bit segment 6, as shown in FIG. 6. The first locking 21*a* means may be arranged to receive said second locking means 22*a* for locking the ring bit assembly 4 and the pilot bit 3 together. In an embodiment, bayonet-locking means, which are well known in the art, may be used as the first 21*a* and second locking means 22*a*.

In an embodiment the first locking means 21*a* may comprise a circumferential grooves 13 located circumferentially along the outer surface of the pilot pit 3. The grooves 13 may have locking shoulders 14 and impact shoulders 15. The second locking means 22*a* may comprise a locking cavity 16 on the inner and upper surface of the ring bit segment 6. The circumferential grooves 13 may be arranged to receive inner surfaces of the ring bit segments 6 and the locking cavities 16 for locking the ring bit assembly 4 and the pilot bit 3 rotationally or radially together when reaming the center hole for the casing 7.

In an embodiment, the first locking means 21*a* may further comprise longitudinal grooves 18*b* located on the outer surface of the pilot bit 3 and they go to the direction of the longitudinal axis of the pilot bit 3; and retrieve shoulders 17. The second locking means 22*a* may further comprise a retrieve cavity 19 located on the upper side surface of the ring bit segment 6. The longitudinal grooves 18*b* and the retrieve shoulders 17 may be arranged to receive the inner surface of the ring bit segments 6 and the retrieve cavities 19 for removing the ring bit assembly 4 from the hole. The inner surface of the ring bit segments 6 is a surface facing the pilot pit 3 when locked together.

Figure 7A:
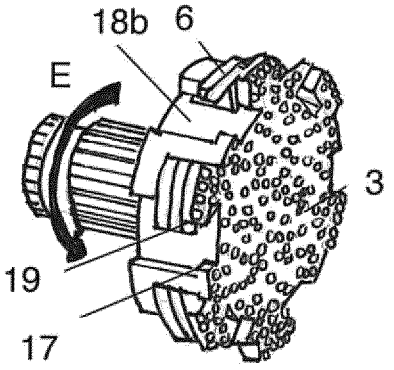
FIG. 7*a* is a side view of a pilot bit when the pilot bit is rotated to lock ring bit segments.
Figure 7B:
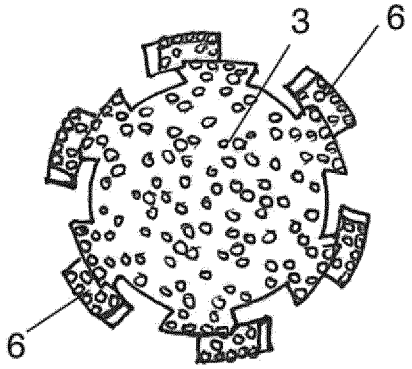
FIG. 7*b* is a front view of the pilot bit of FIG. 7*a* in a drilling position.

FIG. 7*a* shows a side view of a pilot bit when the pilot bit 3 is rotated to lock ring bit segments 6 and pilot bit 3 together. To clarify the FIGS. 7*a* and 7*b*, the carrier 5 of the ring bit assembly 4 is removed. For locking the pilot bit 3 to a drilling position, the pilot bit 3 is first pushed into the casing 7 where the ring bit assembly 4 has been connected to the casing shoe 12. Furthermore, an arrow E shows how the pilot bit 3 may be rotated axially along the first direction to lock the ring bit segments 6 to the drilling position. This means that the pilot bit 3 may be rotated in relation to the carrier 5, when the ring bit segments 6 are not locked to the pilot bit 3. Thus, the pilot bit 3 may be rotated axially along the first direction in relation to the carrier 5. The first direction may be the drilling direction. The pilot bit 3 may be used to provide the rotation and the impact for the ring bit segments 6 and additionally to retrieve the ring bit assembly 4 from the hole. FIG. 7*b* is a front view of the pilot bit of FIG. 7*a* in a drilling position and it shows how the pilot bit 3 has been rotated radially to lock the ring bit segments 6 to the pilot bit 3. In this position, the locking shoulders 14 and the impact shoulders 15 are in use to lock the ring bit segments 6 with the aid of the locking cavity 16 to the drilling position. When the ring bit segments 6 are locked to the drilling position, it is possible to lift the casing 7 with the pilot bit 3 if needed. The locking shoulders 14 and locking cavities 16 secure lifting.

Figure 8A:
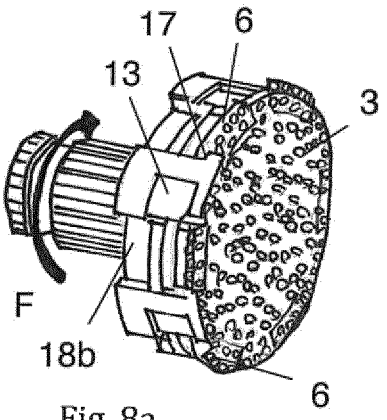
FIG. 8*a* is a side view of a pilot bit when the pilot bit is rotated to unlock ring bit segments.
Figure 8B:
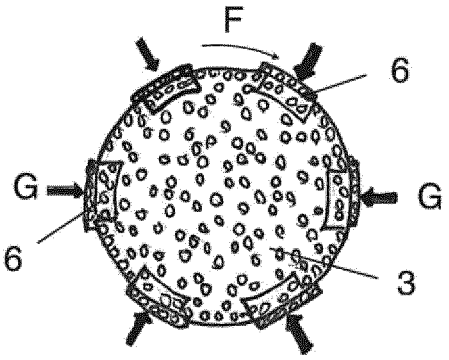
FIG. 8*b* is a front view of the pilot bit of FIG. 8*a* when retrieving the ring bit assembly from the hole.

FIG. 8*a* is a side view of a pilot bit 3 when a pilot bit 3 is rotated to unlock ring bit segments 6 from the pulling means 2. FIG. 8*b* is a front view of the pilot bit 3 shown in FIG. 8*a* when retrieving the ring bit assembly 4 from the hole. To clarify the FIGS. 8*a* and 8*b*, the carrier 5 of the ring bit assembly 4 is not shown. After drilling the hole, the pilot bit 3 may be used to pull up the ring bit assembly 4 out of the hole through the casing 7. An arrow F shows how the pilot bit 3 may be rotated axially along the second direction to unlock the ring bit segments 6 from the drilling positon to the retracting position for removing the ring bit assembly 4. This means that the pilot bit 3 may also be rotated in relation to the carrier 5, when the ring bit segments 6 are unlocked from the pilot bit 3. Thus, the pilot bit 3 may be rotated axially along the second direction in relation to the carrier 5. The second direction may be a retraction direction. FIG. 8*b* is a front view of the pilot bit 3 in a retrieving position. It shows how ring bit segments 6 are reverse rotated to unlock the ring bit segments 6 from the casing shoe 12. In this position a retrieve shoulders 17 of the pilot bit 3 may be coupled with retrieve cavities 19 of the ring bit segments 6, preventing the ring bit segments 6 to move towards the bottom of the hole and allowing the pilot bit 3 to remove the ring bit assembly 4. The longitudinal grooves 18*b* located to the direction of the longitudinal axis of the pilot bit 3, may allow the ring bit segments 6 to move from the circumferential grooves 13 into the grooves 18*b*, according to arrows G, which releases the connection between the ring bit assembly 4 and the casing shoe 7. Subsequently, the ring bit assembly 4 may be lifted out of the hole with the pilot bit 3 without the casing 7. Thus, it is possible to change the ring bit assembly 4 to another, if needed, in the middle of drilling.

In an embodiment is described a method for producing ring bit segments 6 according to the any of the above-mentioned embodiments. First, the method comprising preparing a ring billet. Then segment impact shoulders 10 and segment reamer shoulders 11 are formed. After that, the formed ring billet is cut to smaller pieces for forming ring bit segments 6. In an embodiment, the method may further comprise forming locking cavities 16 and retrieving cavities 19. With this method, production of the ring bit segments is fast and cheap.

It will be obvious to a person skilled in the art that, as the technology advances, the inventive concept can be implemented in various ways. The invention and its embodiments are not limited to the examples described above but may vary within the scope of the claims.

The invention claimed is:

1. A drilling unit for drilling a hole, the drilling unit comprising a drilling head, said drilling head further comprising:

pulling means for pulling a casing into the hole;

a pilot bit for drilling a center hole;

connecting means; and a ring bit assembly for reaming the center hole for the casing;

wherein said ring bit assembly is connected to said pilot bit by the connecting means and to said casing by the pulling means, wherein said ring bit assembly comprises:

a carrier comprising carrier coupling means; and a plurality of ring bit segments movably attached to said carrier coupling means, the pilot bit being connected to the ring bit assembly by the ring bit segments, wherein the carrier coupling means comprise a plurality of carrier holes and carrier ribs, and the ring bit segments comprise a segment impact shoulder and a segment reamer shoulder, wherein said segment impact shoulders are attached into the carrier holes, and wherein said segment reamer shoulders and the segment impact shoulders are arranged to attach the ring bit segments to said carrier ribs from the inside of the carrier when said ring bit segments are in the extended position.

2. A drilling unit according to claim 1, wherein the carrier is uncoupled to the pilot bit.

3. A drilling unit according to claim 1, wherein the ring bit segments are radially extendable and retractable, and wherein said ring bit segments are arranged in an extended position when reaming the center hole for the casing and in a retracted position when removing the ring bit assembly from the hole.

4. A drilling unit according to claim 1, wherein said ring bit segments are arranged in the extended position located further out than an outer diameter of the casing when reaming the center hole for the casing; and in the retracted position located further in than an inner diameter of the casing when removing the ring bit assembly from the hole.

5. A drilling unit according to claim 1, wherein said pulling means comprises a casing shoe at the head of the casing for coupling the casing and the ring bit segments movably together allowing the ring bit assembly to rotate freely around the longitudinal axis of the casing.

6. An arrangement for drilling a hole, comprising the drilling unit according to claim 1 and further comprising a lifting tool for removing the ring bit assembly from the hole.

7. A drilling unit for drilling a hole, the drilling unit comprising a drilling head, said drilling head further comprising:

pulling means for pulling a casing into the hole;

a pilot bit for drilling a center hole;

connecting means; and a ring bit assembly for reaming the center hole for the casing;

wherein said ring bit assembly is connected to said pilot bit by the connecting means and to said casing by the pulling means, wherein said ring bit assembly comprises:

a carrier comprising carrier coupling means; and a plurality of ring bit segments movably attached to said carrier coupling means, the pilot bit being connected to the ring bit assembly by the ring bit segments, wherein the connecting means comprise:

first locking means located on a circumferential outer surface of the pilot bit; and second locking means located on a surface of the ring bit segment; and wherein said first locking means are arranged to receive said second locking means for locking the ring bit assembly and the pilot bit together.

8. A drilling unit according to claim 7, wherein the first locking means comprises longitudinal grooves, wherein the grooves are arranged to receive the ring bit segments for locking the ring bit assembly and the pilot bit together when reaming the center hole for the casing.

9. A drilling unit according to claim 7, wherein the first locking means comprise circumferential grooves and the second locking means comprise a locking cavity on the surface of the ring bit segment, wherein the circumferential grooves are arranged to receive the ring bit segments and the locking cavities for locking the ring bit assembly and the pilot bit together when reaming the center hole for the casing; and the first locking means further comprise longitudinal grooves and retrieve shoulders, and the second locking means further comprise a retrieve cavity on the surface of the ring bit segment, wherein the longitudinal grooves and the retrieve shoulders are arranged to receive the ring bit segments and the retrieve cavities for removing the ring bit assembly from the hole.

10. A drilling unit according to claim 9, wherein the pilot bit is arranged to be rotated in relation to the carrier.

11. A method of making ring bit segments for use with a drilling unit for drilling a hole, the method comprising:

preparing a ring billet;

forming segment impact shoulders and segment reamer shoulders; and cutting the formed ring billet to smaller pieces for forming ring bit segments, wherein the drilling unit comprises a drilling head, said drilling head comprising:

pulling means for pulling a casing into the hole;

a pilot bit for drilling a center hole;

connecting means; and a ring bit assembly for reaming the center hole for the casing;

wherein said ring bit assembly is connected to said pilot bit by the connecting means and to said casing by the pulling means, wherein said ring bit assembly comprises:

a carrier comprising carrier coupling means; and the formed ring bit segments movably attached to said carrier coupling means, the pilot bit being connected to the ring bit assembly by the ring bit segments; wherein the carrier coupling means comprise a plurality of carrier holes and carrier ribs, and the ring bit segments comprise the segment impact shoulders and the segment reamer shoulders, wherein said segment impact shoulders are attached into the carrier holes, and wherein said segment reamer shoulders and the segment impact shoulders are arranged to attach the ring bit segments to said carrier ribs from the inside of the carrier when said ring bit segments are in the extended position.

12. A method according to claim 11, wherein the connecting means comprise:

first locking means located on a circumferential outer surface of the pilot bit; and second locking means located on a surface of the ring bit segment; and wherein said first locking means are arranged to receive said second locking means for locking the ring bit assembly and the pilot bit together.

13. A method of making a drilling unit for drilling a hole, the method comprising:

preparing a ring billet;

forming segment impact shoulders and segment reamer shoulders;

cutting the formed ring billet to smaller pieces for forming ring bit segments; and incorporating the formed ring bit segments into the drilling unit, wherein the drilling unit comprises a drilling head, said drilling head comprising:

pulling means for pulling a casing into the hole;

a pilot bit for drilling a center hole;

connecting means; and a ring bit assembly for reaming the center hole for the casing;

wherein said ring bit assembly is connected to said pilot bit by the connecting means and to said casing by the pulling means, wherein said ring bit assembly comprises:

a carrier comprising carrier coupling means; and the formed ring bit segments movably attached to said carrier coupling means, the pilot bit being connected to the ring bit assembly by the ring bit segments; wherein the carrier coupling means comprise a plurality of carrier holes and carrier ribs, and the ring bit segments comprise the segment impact shoulders and the segment reamer shoulders, wherein said segment impact shoulders are attached into the carrier holes, and wherein said segment reamer shoulders and the segment impact shoulders are arranged to attach the ring bit segments to said carrier ribs from the inside of the carrier when said ring bit segments are in the extended position.

14. A method according to claim 13, wherein the connecting means comprise:

first locking means located on a circumferential outer surface of the pilot bit; and second locking means located on a surface of the ring bit segment; and wherein said first locking means are arranged to receive said second locking means for locking the ring bit assembly and the pilot bit together.

15. A method according to claim 13, wherein the carrier is uncoupled to the pilot bit in the drilling unit.

16. A method according to claim 13, wherein when installed in the drilling unit, the ring bit segments are: radially extendable and retractable, and are arranged in an extended position when reaming the center hole for the casing and in a retracted position when removing the ring bit assembly from the hole.

17. A method according to claim 13, wherein when installed in the drilling unit, said ring bit segments are arranged in the extended position located further out than an outer diameter of the casing when reaming the center hole for the casing; and in the retracted position located further in than an inner diameter of the casing when removing the ring bit assembly from the hole.

18. A method according to claim 13, wherein said pulling means comprise a casing shoe at the head of the casing for coupling the casing and the ring bit segments movably together allowing the ring bit assembly to rotate freely around the longitudinal axis of the casing.

* * * * *